US008925477B2

(12) United States Patent
Wang

(10) Patent No.: US 8,925,477 B2
(45) Date of Patent: Jan. 6, 2015

(54) TRAFFIC CONE

(75) Inventor: Tsang-Kuan Wang, Tainan (TW)

(73) Assignee: Jerry Wang Lee, Tainan (TW)

( * ) Notice: Subject to any disclaimer, the term of this patent is extended or adjusted under 35 U.S.C. 154(b) by 308 days.

(21) Appl. No.: 13/610,181

(22) Filed: Sep. 11, 2012

(65) Prior Publication Data

US 2014/0069321 A1 Mar. 13, 2014

(51) Int. Cl.
*E01F 9/012* (2006.01)

(52) U.S. Cl.
USPC ..... 116/63 C

(58) Field of Classification Search
CPC ..... E01F 9/012; E01F 9/0122; E01F 9/0124
USPC ..... 116/63 C, 63 P; 404/9
See application file for complete search history.

(56) References Cited

U.S. PATENT DOCUMENTS

| | | | | |
|---|---|---|---|---|
| 6,929,419 | B1 * | 8/2005 | Kuo | 404/6 |
| 7,056,055 | B1 * | 6/2006 | Kuo | 404/9 |
| 7,338,229 | B1 * | 3/2008 | Kuo | 404/9 |
| 2010/0107964 | A1 * | 5/2010 | Wang-Lee | 116/63 C |
| 2012/0234228 | A1 * | 9/2012 | Kuo | 116/63 C |

FOREIGN PATENT DOCUMENTS

| | | | | |
|---|---|---|---|---|
| JP | 2006052631 A | * | 2/2006 | E01F 13/02 |
| JP | 2012062677 A | * | 3/2012 | E01F 13/02 |

* cited by examiner

*Primary Examiner* — R. A. Smith
(74) *Attorney, Agent, or Firm* — Jacobson Holman Hershkovitz PLLC; Abraham Hershkovitz

(57) ABSTRACT

A traffic cone has an annular base and a hollow conical body. The annular base has an annular panel having multiple through holes, and multiple first feet protruding down from the annular panel. The conical body has a conical portion and a covering panel radially protruding from a bottom peripheral edge of the conical portion and wrapped on the annular panel. Moreover, even if the traffic cone is bumped or is run over by cars, the annular and the conical body do not separate from each other easily so the traffic cone has prolonged life for use.

8 Claims, 5 Drawing Sheets

TRAFFIC CONE

BACKGROUND OF THE INVENTION

1. Field of the Invention

The present invention relates to a traffic cone, especially to a traffic cone of high safety.

2. Description of the Prior Art(s)

Traffic cones are placed on roads or around construction sites to temporarily redirect traffic or to warn of hazards, etc. Therefore, the traffic cones are helpful to drivers and road construction operations, and are necessities for road rescues.

With reference to FIGS. 4 and 5, a conventional traffic cone comprises a conical body 30 and an annular base 40. The conical body 30 has a conical portion 31, a bottom annular protrusion 32, an outer annular protrusion 33 and multiple mounting holes 34. The conical portion 31 has a bottom peripheral edge. The bottom annular protrusion 32 is integrally formed around and radially protrudes from the bottom peripheral edge of the conical portion 31 and has an outer peripheral surface. The outer annular protrusion 33 is integrally formed around the outer peripheral surface of the bottom annular protrusion 32. The mounting holes 34 are separately formed longitudinally through the outer annular protrusion 33. The annular base 40 has a wrapping portion 41. The wrapping portion 41 is mounted around the outer annular protrusion 33, engages in the mounting holes 34 and has an upper surface being flush with an upper surface of the bottom annular protrusion 32.

Furthermore, the conical body 30 is made of a soft material and has highly visible appearance. The annular base 40 is made of a hard material, which is different from the conical body 30, and lacks high visibility feature. Moreover, the annular base 40 is thick and heavy to provide a very low center of gravity such that the conventional traffic cone can not be blown over by strong wind, hence the annular base 40 is unable to be omitted.

However, the conventional traffic cone is formed by combining the conical body 30 and the annular base 40 with two different materials, one material providing the high visibility warning effect, such as fluorescent orange while the other material not providing the warning effect. If the conventional traffic cone is bumped, the conical body 30 and the annular base 40 easily separate from each other. Moreover, the conventional traffic cone is unable to provide a whole warning function because only the conical body 30 provides the warning effect.

To overcome the shortcomings, the present invention provides a traffic cone to mitigate or obviate the aforementioned problems.

SUMMARY OF THE INVENTION

The main objective of the present invention is to provide a traffic cone. The traffic cone has an annular base and a hollow conical body. The annular base has an annular panel having multiple through holes, and multiple first feet protruding down from the annular panel. Each first foot has a mounting recess communicating with at least one of the through holes of the annular panel. The conical body has a conical portion and a covering panel. The covering panel protrudes from a bottom peripheral edge of the conical portion, is wrapped on the annular panel and has multiple positioning protrusions respectively mounted through the through holes of the annular panel and multiple retainers respectively disposed in the mounting recesses of the first feet and attached to the positioning protrusions.

Moreover, even if the traffic cone is bumped or is run over by cars, the annular and the conical body do not separate from each other easily so the traffic cone has prolonged life for use.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
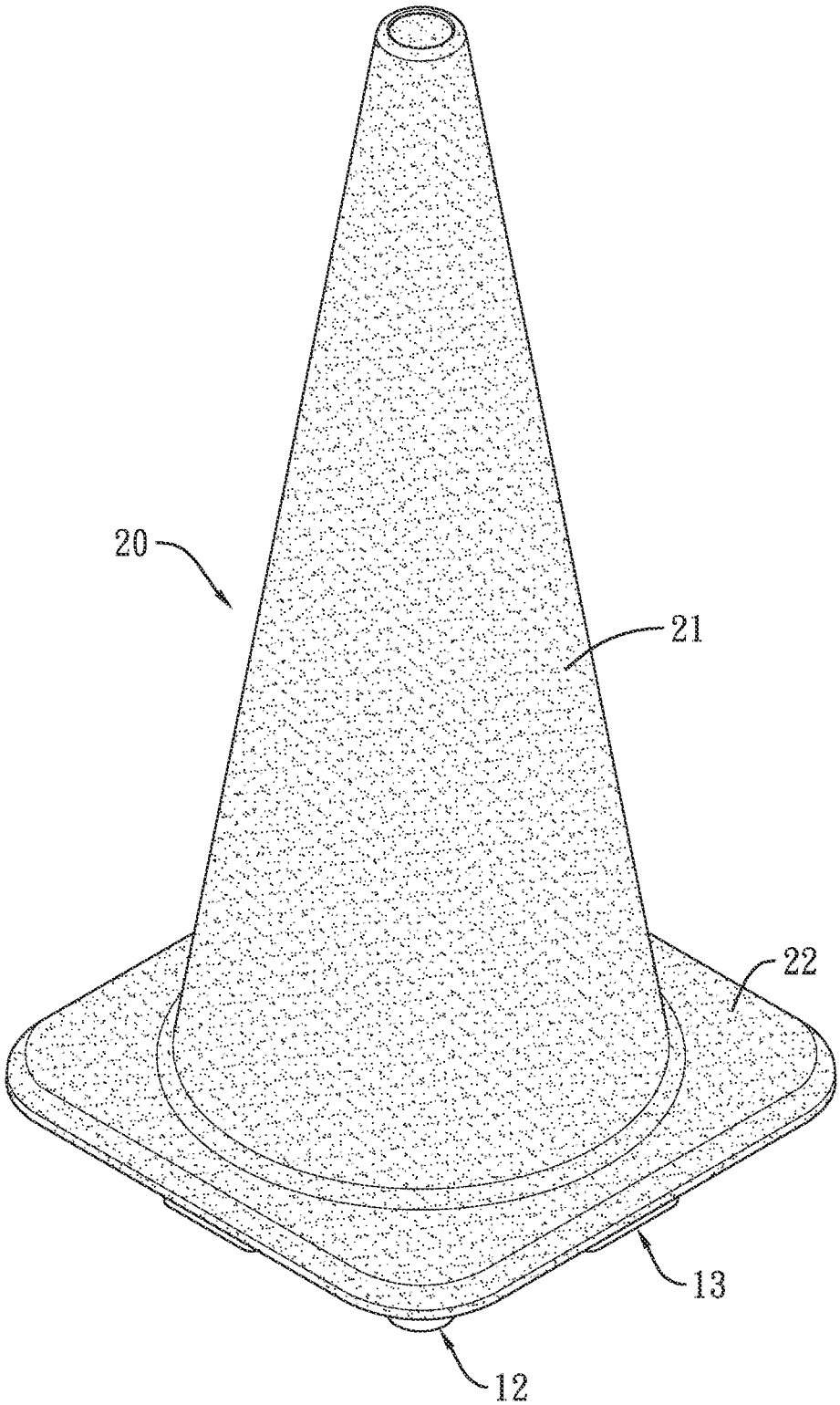
FIG. 1 is a top perspective view of a traffic cone in accordance with the present invention.
Figure 2:
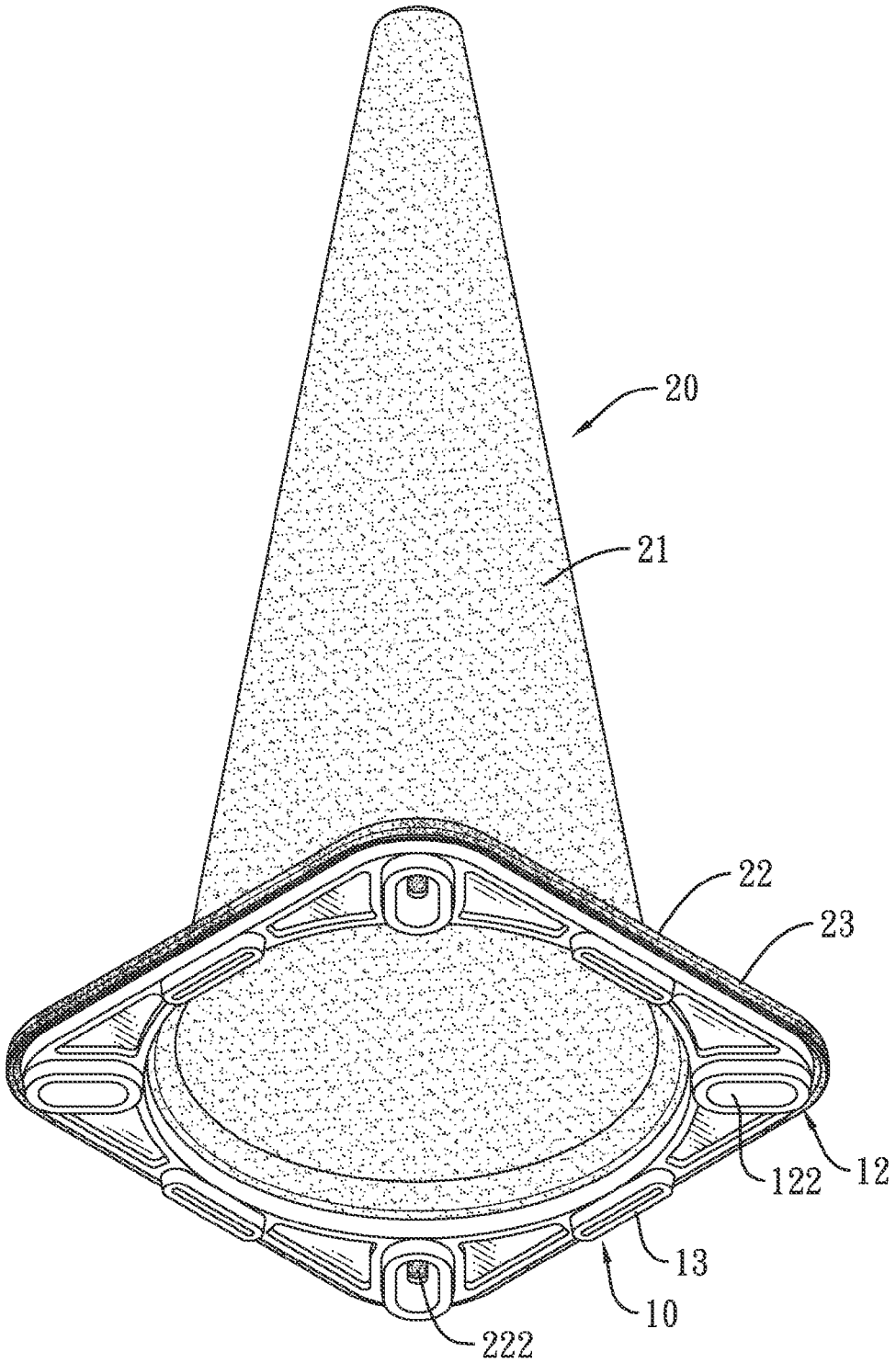
FIG. 2 is a bottom perspective view of the traffic cone in FIG. 1.

With reference to FIGS. 1 and 2, a traffic cone in accordance with the present invention comprises an annular base 10 and a hollow conical body 20.

Figure 3:
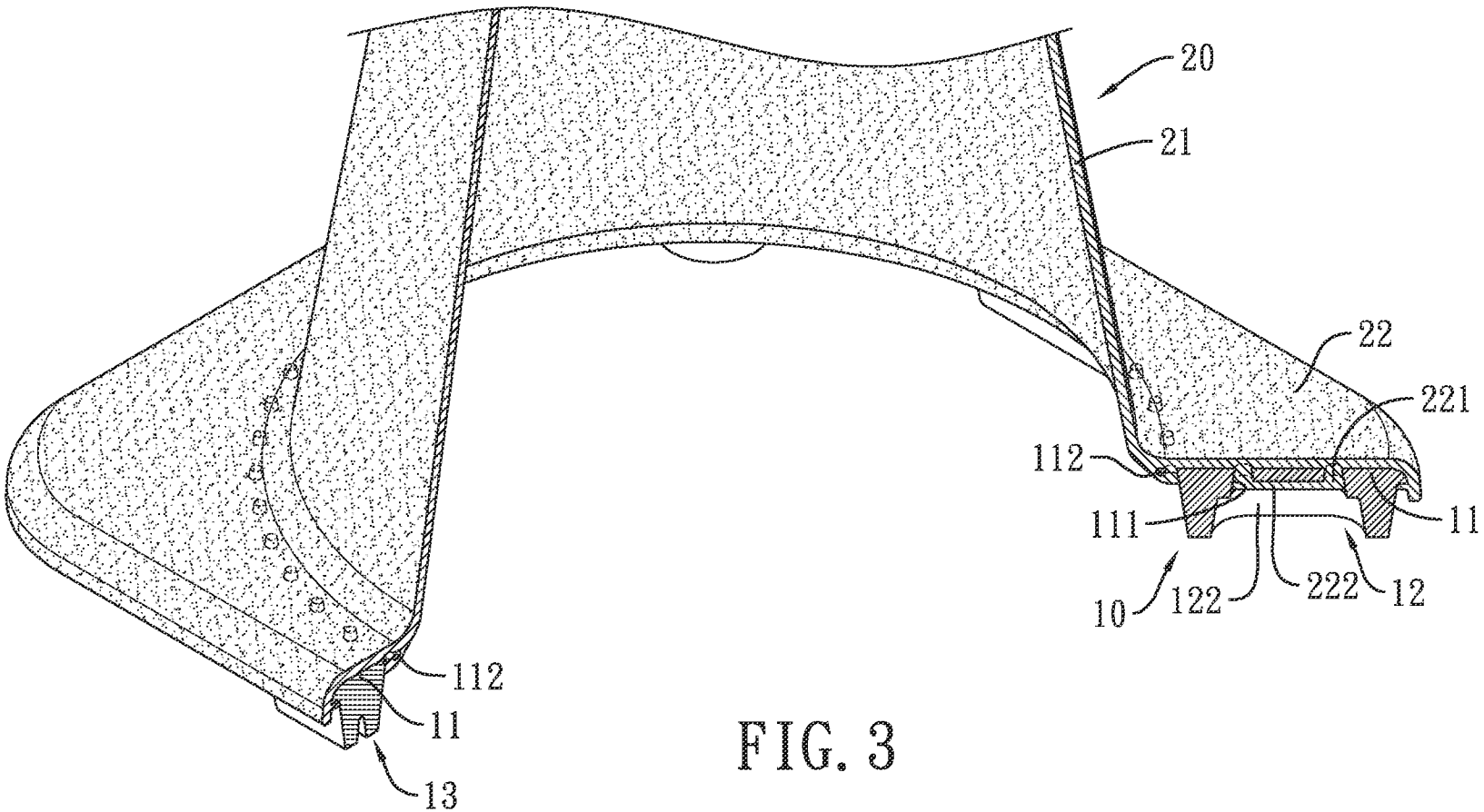
FIG. 3 is an enlarged cross-sectional perspective view of the traffic cone in FIG. 1.
Figure 4:
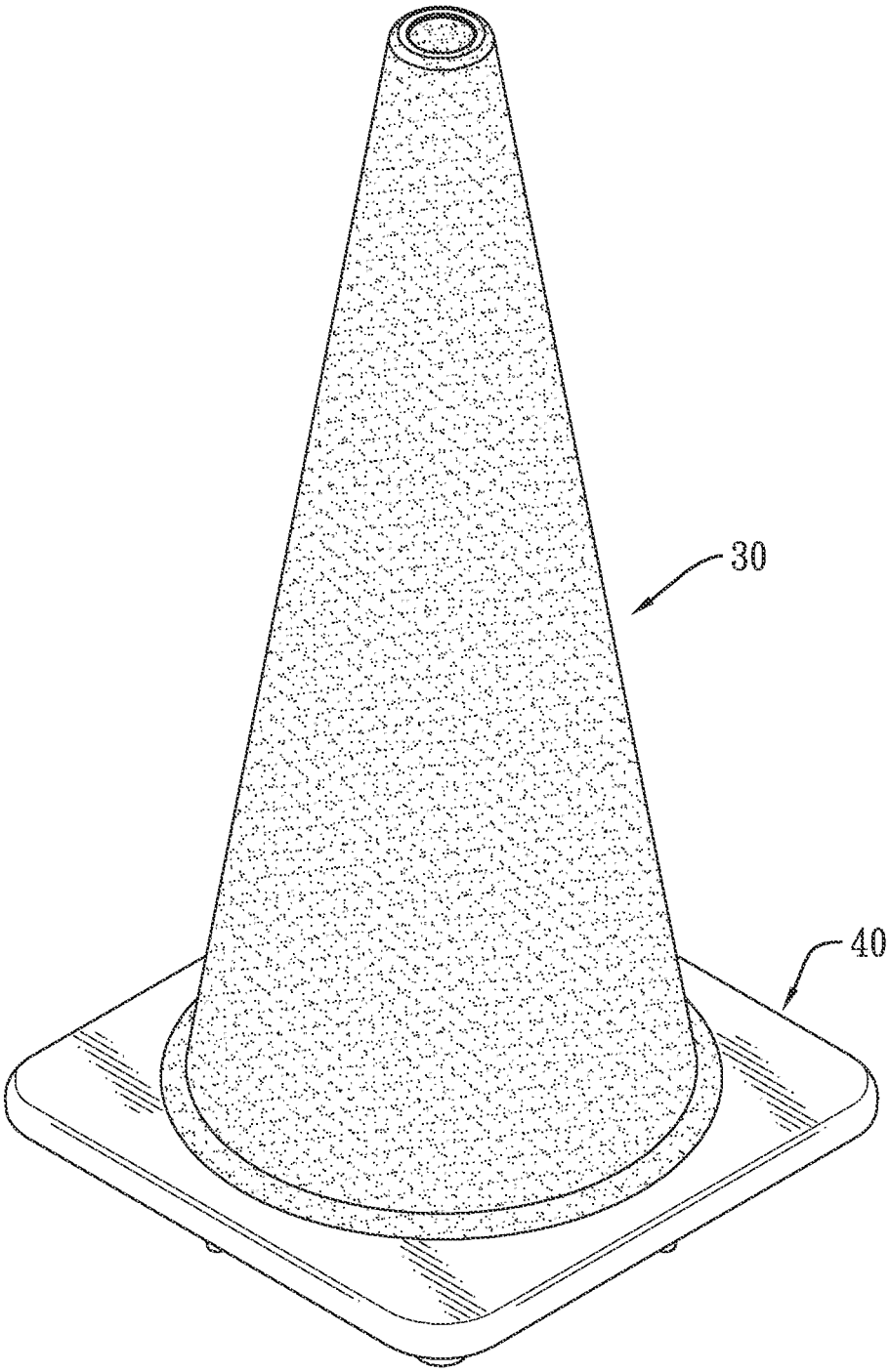
FIG. 4 PRIOR ART
FIG. 4 is a top perspective view of a conventional traffic cone in accordance with the prior art.
Figure 5:
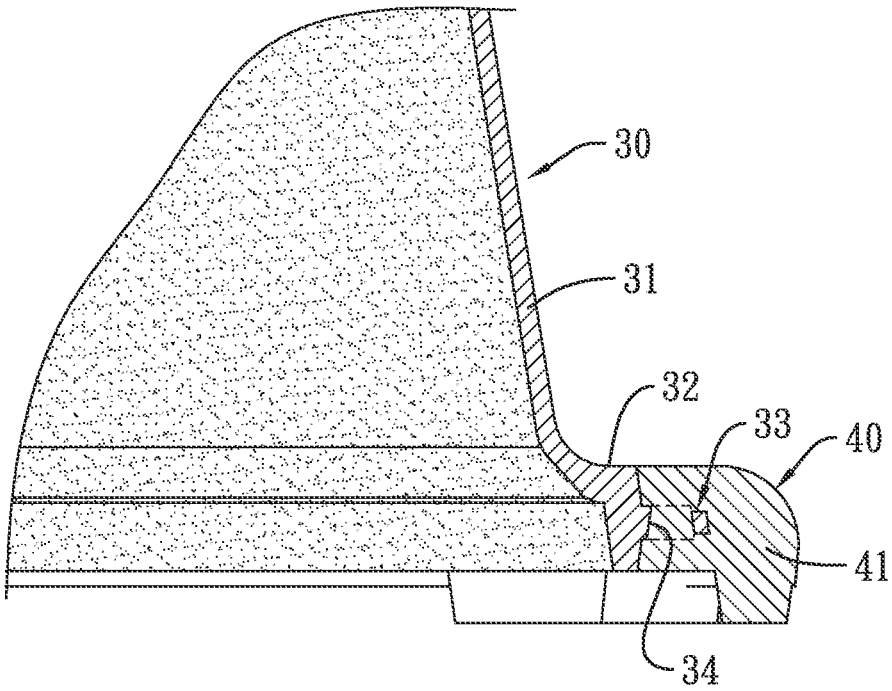
FIG. 5 PRIOR ART
FIG. 5 is an enlarged cross-sectional side view of the conventional traffic cone in FIG. 4.

With further reference to FIG. 3, the annular base 10 has an annular panel 11, multiple first feet 12 and multiple second feet 13.

The annular panel 11 has an upper surface, a lower surface, an inner peripheral edge, multiple through holes 111 and multiple extending portions 112. The through holes 111 are separately formed longitudinally through the annular panel 11. The extending portions 112 separately protrude transversely from the inner peripheral edge of the annular panel 11.

With reference to FIGS. 2 and 3, the first feet 12 separately protrude down from the lower surface of the annular panel 11. Each first foot 12 is polygonal, corresponds to at least one of the through holes 111 of the annular panel 11 and has a bottom surface and a mounting recess 122. The mounting recess 122 is formed in the bottom surface of the first foot 12 and communicates with the at least one of the through holes 111 of the annular panel 11 that corresponds to the first foot 12.

The second feet 13 separately protrude down from the lower surface of the annular panel 11. Each second foot 13 is disposed between two of the first feet 12 that are adjacent to each other.

The conical body 20 is mounted on the upper surface of the annular panel 11 of the annular base 10 and has a conical portion 21 and a covering panel 22. The conical portion 21 is circular in cross-section and has a bottom peripheral edge. The covering panel 22 is polygonal, radially protrudes from and is formed around the bottom peripheral edge of the conical portion 21, is wrapped on the upper surface of the annular panel 11 of the annular base 10, is wrapped around the extending portions 112 of the annular panel 11, and has a lower surface, multiple positioning protrusions 221 and multiple retainers 222. The positioning protrusions 221 protrude down from the lower surface of the covering panel 22 and are respectively mounted through the through holes 111 of the annular panel 11. The retainers 222 are respectively disposed in the mounting recesses 122 of the first feet 12 and are attached to the positioning protrusions 221. Thus, the annular base 10 is securely held on the lower surface of the covering panel 22 of the conical body 20.

The traffic cone as described has the following advantages. The covering panel 22 of the conical body 20 is mounted on the annular panel 11 of the annular base 10 to provide two planes of high visibility surfaces. Therefore, the traffic cone has an effective warning effect. Moreover, the conical body 20 securely holds the annular base 10. Even if the traffic cone is bumped or is run over by cars, the annular 10 and the conical body 20 do not separate from each other easily so the traffic cone has prolonged life for use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A traffic cone comprising:

an annular base having:

an annular panel having multiple through holes separately formed longitudinally through the annular panel; and multiple first feet separately protrude down from a lower surface of the annular panel, and each first foot corresponding to at least one of the through holes of the annular panel and having a bottom surface and a mounting recess formed in the bottom surface of the first foot and communicating with the at least one of the through holes of the annular panel that corresponds to the first foot;

a hollow conical body mounted on an upper surface of the annular panel of the annular base and having a conical portion having a bottom peripheral edge; and a covering panel radially protruding from and formed around the bottom peripheral edge of the conical portion, wrapped on the upper surface of the annular panel of the annular base, and having multiple positioning protrusions protruding down from a lower surface of the covering panel and respectively mounted through the through holes; and multiple retainers respectively disposed in the mounting recesses of the first feet and attached to the positioning protrusions.

2. The traffic cone as claimed in claim 1, wherein the annular base further has multiple second feet separately protruding down from the lower surface of the annular panel, and each second foot disposed between two of the first feet that are adjacent to each other.

3. The traffic cone as claimed in claim 2, wherein the annular panel of the annular base further has an inner peripheral edge and multiple extending portions separately protruding transversely from the inner peripheral edge of the annular panel; and the covering panel of the conical body is wrapped around the extending portions of the annular panel.

4. The traffic cone as claimed in claim 3, wherein the conical portion of the conical body is circular in cross-section;

the covering panel of the conical body is polygonal; and each first foot of the annular base is polygonal.

5. The traffic cone as claimed in claim 2, wherein the conical portion of the conical body is circular in cross-section;

the covering panel of the conical body is polygonal; and each first foot of the annular base is polygonal.

6. The traffic cone as claimed in claim 1, wherein the annular panel of the annular base further has an inner peripheral edge and multiple extending portions separately protruding transversely from the inner peripheral edge of the annular panel; and the covering panel of the conical body is wrapped around the extending portions of the annular panel.

7. The traffic cone as claimed in claim 6, wherein the conical portion of the conical body is circular in cross-section;

the covering panel of the conical body is polygonal; and each first foot of the annular base is polygonal.

8. The traffic cone as claimed in claim 1, wherein the conical portion of the conical body is circular in cross-section;

the covering panel of the conical body is polygonal; and each first foot of the annular base is polygonal.

* * * * *